US007987801B2

(12) United States Patent
Ecker et al.

(10) Patent No.: US 7,987,801 B2
(45) Date of Patent: Aug. 2, 2011

(54) DEVICE AND METHOD FOR MONITORING A THREAD WOUND ON A BOBBIN

(75) Inventors: Andreas Ecker, Nürtingen (DE); Martin Brenner, Kirchheim (DE)

(73) Assignee: RSG Rombold System GmbH & Co., KG (DE)

( * ) Notice: Subject to any disclaimer, the term of this patent is extended or adjusted under 35 U.S.C. 154(b) by 0 days.

(21) Appl. No.: 12/307,354

(22) PCT Filed: Mar. 28, 2006

(86) PCT No.: PCT/EP2007/002769

§ 371 (c)(1),
(2), (4) Date: Jan. 2, 2009

(87) PCT Pub. No.: WO2007/110239

PCT Pub. Date: Oct. 4, 2007

(65) Prior Publication Data

US 2010/0126400 A1 May 27, 2010

(30) Foreign Application Priority Data

Mar. 28, 2006 (DE) ..... 10 2006 014 361

(51) Int. Cl.
*D05B 59/02* (2006.01)

(52) U.S. Cl. ..... 112/475.02; 112/278

(58) Field of Classification Search ..... 112/475.01, 112/475.02, 273, 278, 279
See application file for complete search history.

(56) References Cited

U.S. PATENT DOCUMENTS

| | | | | | |
|---|---|---|---|---|---|
| 5,018,465 | A | * | 5/1991 | Hager et al. | 112/273 |
| 5,161,475 | A | * | 11/1992 | Tawara et al. | 112/278 |
| 5,211,121 | A | * | 5/1993 | Sakakibara | 112/278 |
| 5,267,518 | A | * | 12/1993 | Arnold et al. | 112/475.02 |
| 5,350,127 | A | * | 9/1994 | Arnold et al. | 242/475.7 |
| 5,353,726 | A | * | 10/1994 | Bruder et al. | 112/475.02 |
| 6,863,007 | B2 | * | 3/2005 | Fluckiger | 112/475.01 |

FOREIGN PATENT DOCUMENTS

| | | | | |
|---|---|---|---|---|
| DE | 3540126 | A1 | * | 2/1987 |
| JP | 04164490 | A | * | 6/1992 |
| JP | 05115651 | A | * | 5/1993 |

* cited by examiner

*Primary Examiner* — Danny Worrell
(74) *Attorney, Agent, or Firm* — Apex Juris, PLLC; Tracy M. Heims

(57) ABSTRACT

The present invention relates to a device and a method for monitoring a thread wound on a bobbin during operation in a sewing machine that reduces the expenditure on apparatus and production technology with increased monitoring reliability wherein at least three different marking states are provided in the area of the bobbin (3) and are coupled to an optical device (8) in such a manner that movement of the bobbin (3) produces a change in marking which can be detected in the optical device (8) which can be evaluated in a logic unit connected to the optical device (8), that the marking (10) in the area of the bobbin (3) comprises more than two states, wherein at least one state is defined by at least one true color (g, r, b) or a mixture of the primary colors.

19 Claims, 2 Drawing Sheets

DEVICE AND METHOD FOR MONITORING A THREAD WOUND ON A BOBBIN

BACKGROUND OF THE INVENTION

The present invention relates to a device and a method for monitoring a thread wound on a bobbin during operation in a sewing machine.

It is known from various investigations that a bobbin on a sewing machine runs in a very uncontrolled manner during the sewing process. For example, a marking-off of the rotary movement takes place after the beginning of each sewing process, the time of the marking-off and the strength of the incipient rotary movement and the acceleration of the bobbin depending, among other things, on the degree of filling of the bobbin, on the material of the thread and the wear of the mechanical elements in the area of the bobbin, to mention just a few of the possible influential factors. The movement of the bobbin thus cannot substantially be predicted and as a consequence, cannot be described mathematically even when considered from the start of the sewing process.

These general statements apply both to the upper thread and to the lower thread of a sewing machine. However, since any type of monitoring and control in the area of the lower thread poses a major technical challenge because of the very confined spatial proportion, without restricting the invention to this particular case, only monitoring of the lower thread during operation of a sewing machine will be discussed hereinafter.

Various proposed solutions for monitoring a lower thread of a sewing machine for thread breaks or broken threads are known from the prior art. Starting from devices for residual thread monitoring in a lower bobbin, an optical device is known from DE 30 14 753 C2, for example, comprising a light-emitting diode and a photodetector which passes light through holes directed parallel to the axis of rotation of the lower bobbin when the lower thread on the lower bobbin is largely used up. Monitoring of the filling level of the bobbin is therefore performed using the dark/light transition.

In a further development according to DE 34 47 138 C2, a reflecting surface on the bobbin is used to arrange a transmitter and detector substantially as a compact unit only on one side of the lower bobbin on the sewing machine. Incident radiation is strongly absorbed by the thread through holes whilst webs between the holes and a metal rear wall of the bobbin reflect strongly. In this case, a constant continuous signal from the receiver unit is assessed as an indicator that the bobbin is at a standstill which can also occur as a consequence of a thread break.

In order to increase the reliability in this environment exposed to dust and thread abrasion, DE 41 15 520, for example, proposes a special guidance of the lower thread in the course of unwinding the lower bobbin. By this means falsifying impairments of the reflection caused by contaminant accumulations on the reflecting surfaces should be continuously cleaned by quasi-permanent wiping of these surfaces by the running-off thread.

For further monitoring tasks in the area of the lower bobbin, reference is made to the teaching of DE 35 40 126 A1 as an example. In this teaching, in order to achieve more extensive monitoring tasks, three optical sensor cells must cooperate in interplay with two different annular markings or marking units to be applied to a front side of the bobbin.

It is thus the object of the present invention to further develop a method and a device of the type specified initially whilst reducing the expenditure on apparatus and production technology with increased monitoring reliability.

This object is achieved by the features of the independent claims. Advantageous further developments are the subject matter of the dependent claims.

BRIEF SUMMARY OF THE INVENTION

The present invention is based on the finding that the proposed solutions according to the prior art are always based on a binary decision between two marking states. Thus, either more than 70% of the incident radiation is reflected by a white or silver or mirrored surface or more than 90% of the radiation is absorbed by threads or a blackened surface. In practice, this principle is comparatively prone to error despite the widely spaced threshold values of the logical decisions to be made. In addition, it has been found that a device according to this principle can only be extended at very high expenditure.

In contrast, in order to reduce the complexity of a monitoring device and substantially simplify a corresponding method, the invention proposes a device for monitoring a thread wound on a bobbin during operation in a sewing machine, wherein at least two different marking states are provided in the area of the bobbin and are coupled to an optical device in such a manner that movement of the bobbin produces a change in marking, which change can be detected in the optical device which can be evaluated in a logic unit connected to the optical device, the marking comprising more than two states in the area of the bobbin and at least one state being defined by at least one colour or a mixture of primary colours.

When considered from the physical viewpoint, the markings used according to the prior art in white/silver or mirrored on the one hand and black or very dark on the other hand, are not colours. By constructing a marking which additionally also has a colour or a colour panel compared to the marking known from the prior art, the hitherto only binary recognition space has been expanded to a state space comprising three states which can be clearly distinguished from one another. In particular, beside stoppage it is hereby possible using one optical device only to reliably and correctly detect a respective direction of rotation of the bobbin.

In addition, in the event of a thread break or broken thread in the area of the lower bobbin, it is now possible to detect the very common defect that the lower bobbin does not come to a standstill after the thread break but decays into a type of jitter or oscillating motion during the sewing process. This type of oscillating motion can be incorrectly interpreted as rotary motion by known detector devices. However, since oscillating motion usually only represents a change between two neighbouring marking states, a device according to the invention lacks a third state value so that this case of error is reliably detected by the method according to the invention in the course of a deviation from the defined pre-determined change in colour or marking state.

Since a device according to the invention and a corresponding method can be used both for a lower thread and for an upper thread, all possible versions of mock sewing can be reliably eliminated within the scope of the present invention. In this context, the person skilled in the art understands by mock sewing the result of sewing in which the seam only comprises one thread and is not secure on account of the complete absence of the second thread. The case is usually encountered in practice where the sewing by the upper thread becomes mock sewing as a result of the absence of the securing lower thread. Such defective seams can only be detected in the course of quality control. However, testing carried out subsequently can effect nothing other than finding in this additional work step the errors of the preceding work phases or work steps. A device according to the invention can effectively avoid errors already in the working phase in the sense of the Poka yoke approach.

Furthermore, an output signal of a corresponding device determined by a method according to the invention can be used for switching off and fault indication. In addition, the passes through the defined pattern change can be used for a very reliable counter for revolutions of the relevant bobbin for an estimate of the residual thread length frequently provided in sewing machines.

Finally, the two directions of rotation can be clearly distinguished from one another as a result of the sequence of the marking states. Thus, as a result of the possibility of distinguishing in the direction of rotation, it can be ensured that a bobbin has always been correctly inserted, what means having the correct winding direction. The winding direction is very important when unwinding thread or yarn from a bobbin. The seam construction diagram and tendency to tearing of the lower thread, which is usually relatively thin, differ substantially as a result of the different unwinding resistance depending on the winding direction. Winding directions which are the same in practice are therefore predefined differently when supplying thread to an automatic sewing machine. Consequently, a lower bobbin inserted in the inverted direction would be identified as a source of production error by a device according to the invention in the sense of the Poka yoke approach before this resulted in defects in the following sewing process. As a continuation of this idea, a change of a lower bobbin is preferably monitored and optionally also logged by at least one sensor. In particular, the circumstance that at least one light/dark transition can be detected in the course of a bobbin change at an axial sensor or a sensor which senses perpendicular to the axis of rotation, when the machine is at a standstill is used for this purpose. Alternatively or additionally, in one exemplary embodiment of the invention, the colour sensor is tested for reliability by withdrawing thread when the machine is at a standstill until all defined states have been passed through at least once and have been notified as recognised. After this test, the machine is released and a sewing process can be carried out in the usual manner.

In a preferred embodiment of the invention, a marking consists of one panel each in white or silver, black and a true colour or mixture of the primary colours. In this case, the colours yellow, red, blue and/or green are preferably used. In this embodiment, the binary state 1 is represented by the white or silver-coloured highly reflecting panel and the state 0 is represented by the black panel, as it is already the case according to the prior art. A third state is introduced by the specific recognition of an additionally introduced colour which now defines a sequence of different signal or marking states. A corresponding device for implementing a method according to the invention can be achieved by expanding known lower thread monitoring systems by a colour sensor which can be provided with its own light source and corresponding incorporation of an allocated colour state in a known marking. A design comprising one light source and two sensors would therefore be technically possible as an example and shows the low expenditure with increased performance of the device according to the invention. However, it is particularly preferable to use a marking having only coloured or differently coloured states since the previously described triggers of binary switching states can also occur in the course of error states caused in particular by contamination or detector defects.

The thread monitored in a device according to the invention is preferably a lower thread and the corresponding bobbin is a lower bobbin. In this context, the marking is preferably provided on at least one of the two outer front sides of the bobbin. In a particularly preferred embodiment of the invention, the marking is provided identically on both outer front sides of the bobbin with the same colour sequence of markings. This has the effect that the bobbin can be used universally. The correct insertion of the bobbin is then only dependent on the pre-determined winding direction.

The markings are preferably provided in the form of colour segments or annular sections radially to an axis of rotation of the bobbin. In this case, an arrangement, for example, in electro discharge machinings on the body of the bobbin is preferred among other things to protect the marking from mechanical influences. Webs between the individual machinings can then form boundaries of the colour surfaces, which simplifies production whilst providing a sharp separation between states.

In a preferred embodiment of the invention, an active multi-colour radiation source and a detector matched to this are provided as the optical device, which cooperate with corresponding markings and in particular, with markings in the colours red, green and blue. Reliably operating, very compact assemblies are available on the market for this purpose, including those designated as rgb sensors. These can be individually calibrated once to the respective colour states for initialisation.

In a particularly preferred embodiment of the invention, a nozzle for producing a contamination-repelling excess pressure area is disposed on the optical device. For this purpose, purified compressed air metered and triggered by a solenoid valve is blown into the optical region between the marking of a bobbin on the one hand and the optical device on the other hand, which is usually sensitive to contamination. Thus, as a result of the prevailing excess pressure, no dust, thread abrasion or oil mist can accumulate here.

BRIEF DESCRIPTION OF THE SEVERAL VIEWS OF THE DRAWING

An exemplary embodiment of the invention will now be explained in detail hereinafter to illustrate further advantages and properties with reference to the diagrams in the drawings. In the drawings.

DETAILED DESCRIPTION OF THE INVENTION

Figure 1:
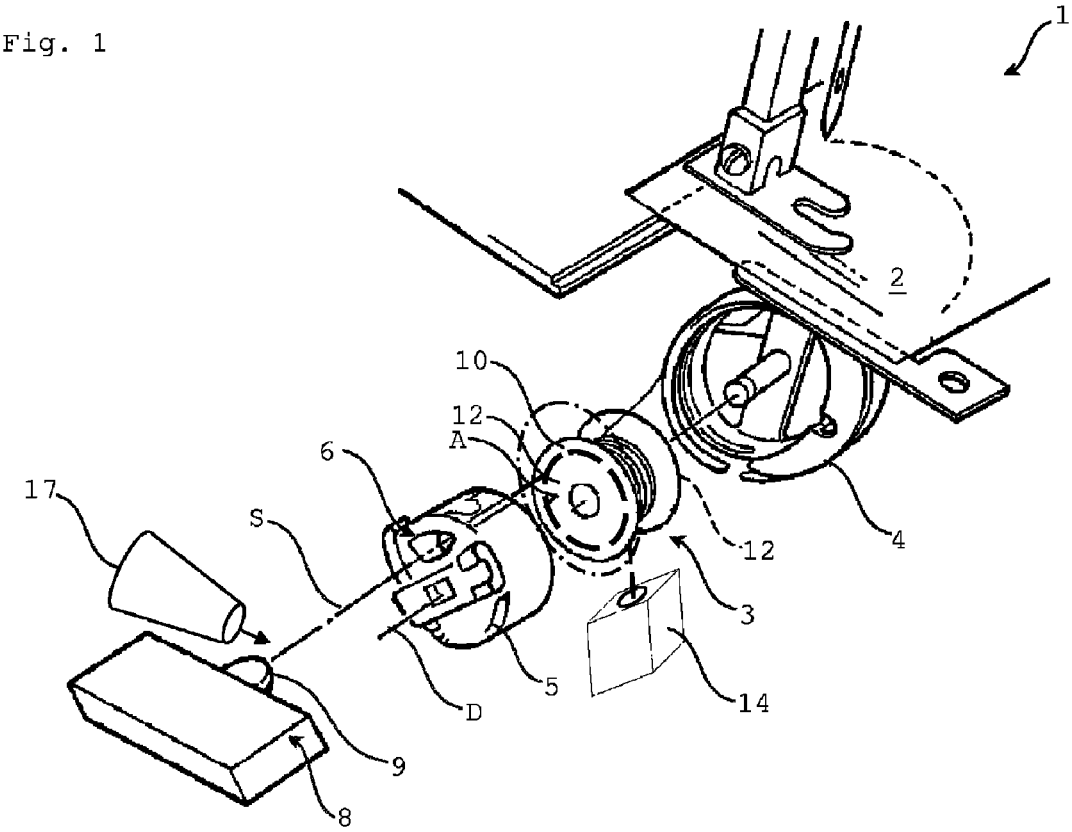
FIG. 1: is a perspective exploded view of a device according to the invention.

The same designations and reference numerals are used as standard over the various diagrams for the same parts.

FIG. 1 shows an exploded view of a section of a known sewing machine 1 in which a bobbin 3 is held in a rotary gripper 4 under a sewing table 2 and is covered with a bobbin casing 5. The bobbin casing 5 has a recess 6 through which radiation from an optical device 8 comprising an active multi-colour radiation source 9 passes along a radiation axis S onto a marking 10 on an outer front side 12 of the bobbin 3 comprising a plurality of marking states, is reflected there and is reflected to a detector device arranged in a manner not shown in further detail in the region of the active multicolour radiation source 9. A so-called digital rgb sensor with integrated optics and triggering and evaluation electronics is used as the optical device 8 in a compact design. The operating mode is discussed in detail hereinafter with reference to the diagrams in FIGS. 2 and 3, where these figures show that both outer front sides A, B are marked the same way.

In addition to the first optical device 8 described hereinbefore, a second optical device 14 which is binary or which operates using black-white contrast, is provided in a mounting position of the bobbin 3. This second optical device 14 is aligned substantially onto an axis of rotation D of the bobbin 3 in the operating state. This forms a residual thread monitor since it can only distinguish in a known fashion between the states "thread present" and "reflecting bobbin base". In addition to infrared radiation, other radiation in and outside the visible light can also be used.

Figure 2:
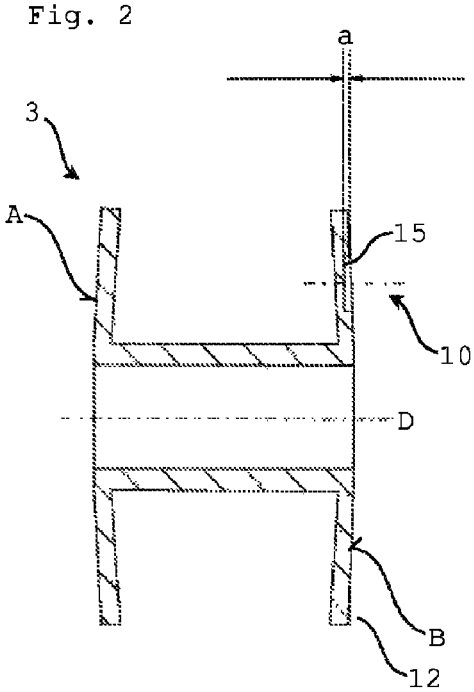
FIG. 2: is a sectional view of a lower bobbin configured according to the invention.

FIG. 2 shows the bobbin 3 in a side sectional view from which it can be seen that the bobbin 3 has electro discharge machinings 15 in the area of one outer front side 12 in which the markings 10 are arranged in a protected manner by recessing by a value "a" before mechanical stressing by brake springs etc. which in particular are components of the bobbin casing 5.

Figure 3:
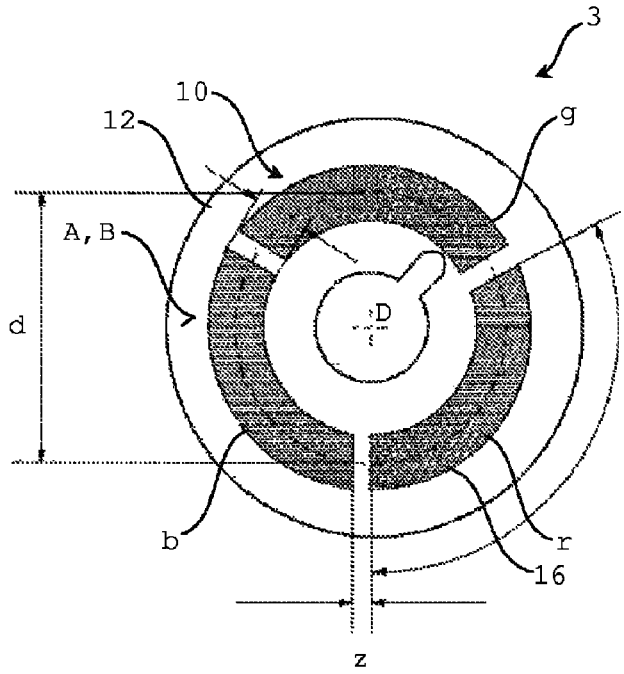
FIG. 3: is a plan view of a front outer surface of the bobbin from FIG. 2.

FIG. 3 shows a plan view of the outer front side 12 of the bobbin from FIG. 2. It can be clearly seen from FIG. 3 that the markings 10 are arranged concentrically around the axis of rotation D of the bobbin 3 in the form of three annular segments 16, with intermediate spaces z formed by webs, in the colours green g, red r and blue b. An average diameter d of the annular segments 16 is selected to correspond to the position of the recess 6 on the bobbin casing 5. The optical device thus detects a pattern sequence in the colours green, red, blue in one direction of rotation of the bobbin but a colour sequence green, blue, red in the opposite direction of rotation. These colour sequences are clearly distinguishable from one another so that the two directions of rotation of the bobbin 3 can be clearly distinguished from one another in a logic unit connected to the optical device 8 and not shown in further detail.

Two outer front sides 12 of the bobbin 3 are coded in a manner not shown further in FIG. 2 so that such a bobbin 3 can be universally used. A distinction merely needs to be made with regard to the winding direction when inserting the bobbin 3. However, since each of the possible directions of rotation of the bobbin 3 can be detected by means of a colour change in the manner described hereinbefore, a bobbin 3 which has been wrongly inserted with regard to its winding direction can be recognised immediately. In this case, a sewing process would be interrupted immediately, giving a suitably specific error message in the sense of the Poka yoke approach.

If the bobbin 3 comes to a standstill, only one of the colour signals g, r, b would be detected permanently. If the bobbin undergoes jitter, only a change between the markings b and r would be detected, for example. In both cases, a subsequent logic circuit would immediately detect a fault in the operation.

When a sewing machine 1 is started up again in a known fashion, a so-called follow-up quantity of thread on the lower bobbin 3 shown here must first be used up before the lower bobbin 3 can turn again. Thus, a turning of the bobbin 3 by incipient pattern changes is only detected by means of the optical device 6 with a time delay with respect to the beginning of sewing. In the present exemplary embodiment, this bobbin follow-up is taken into account by a stitch counter in this example waiting for seven stitches from restarting the sewing process before indicating a probable thread break of the lower thread when no turning of the bobbin 3 is detected. Thus, an error message with a forced switch-off of the sewing machine 1 is only brought about after making the seventh sewing stitch. From starting a new sewing process or changing a sewing movement, a measure of about 5 to about 19 stitches without detecting a turning of the bobbin 3 is to be awaited before outputting an error message.

This measure is set once by the person skilled in the art depending on the geometry or thickness and material stiffness of the sewing material and stitch length of a certain form of seam, as is specified hereinafter with reference to a specific example.

A nozzle 17 exposed to purified compressed air is provided to keep the optical device 8 clean, as is indicated in the diagram in FIG. 1. The purified compressed air, being triggered by a solenoid valve with a relevant control circuit not shown in further detail, creates an excess pressure region between the optical device 8 and the marking 10 on the outer front side 12 of the bobbin. This largely eliminate accumulations of dust and thread abrasion but also deposition of oil or coolant and lubricant mist in this sensitive area for optical recognition. Consequently, such a device operates in a substantially more trouble-free manner compared to known devices.

Such a nozzle 17 can naturally also be used in the area of the second optical device 14. However, this second optical device 14 using a binary decision based on a strong light/dark contrast is merely used for residual thread monitoring on the bobbin 3, as is already known per se from the prior art.

In an exemplary embodiment of the invention not presented in further detail, as a modification of the diagram in FIG. 3, a multiple of the previously described pattern sequence of the colour signals g, r, b is arranged on the outer front side 12 of the bobbin 3. A lower bobbin 3 configured in such a manner is used in cases or applications where only a few seam stitches and then only with a short stitch length in each case need to be passed through per sewing process. The sensitivity is significantly enhanced by the arrangement of two successive colour sequences g, r, b. The start-up of the lower bobbin 3 is detected even earlier by arranging three successive colour signal sequences g, r, b at a time. As a result of the geometry being fixedly predefined within wide ranges, the interaction with mechanical components under severe ambient conditions and the normal vibrations of a sewing machine 1, more extensive refinements are only appropriate in exceptional cases. In practical use, bobbins 3 with one, two or three successive colour signal sequences g, r, b are preferably used.

Figure 4:
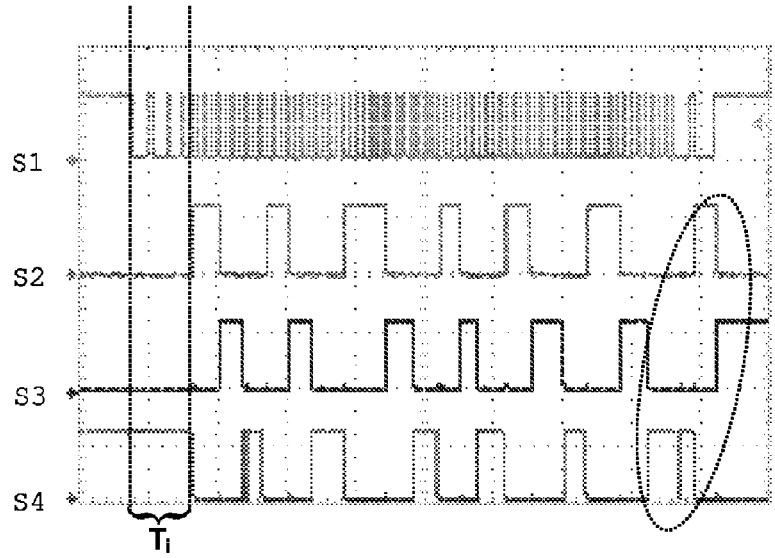
FIG. 4: is a time profile diagram of four signals with the needle sensor signal as a trigger for the individual signals of an rgb colour sensor

FIG. 4 shows a time diagram of a profile of four signals from a system test under real conditions as a printed screen shot. This comprises the individual output signals S2, S3, S4 of an rgb colour sensor, i.e. detected colour change, with a needle sensor signal S1 as the trigger. These measurement curves clearly show the discontinuous running of the bobbin 3 which is caused, among other things, by the nonuniform profile of the needle sensor signal S1 or the associated change in a stitch frequency. On closer examination of the starting sequence, it is noticeable that at the very beginning, a number of stitches is executed without a colour change being detected. During this time interval, hereinafter designated as inactive time $T_i$, a follow-up quantity of thread present in each case is consumed, this having already been withdrawn from the thread roll in the course of a preceding cutting process. This follow-up quantity of thread and an associated inactive time $T_i$ depends on the design of a sewing head used in each case, a thread thickness and a thread length consumed per stitch and not only on a respective stitch length.

At the end of the sewing process, a disproportionate thread consumption occurs in the oval region bordered by the dotted line in FIG. 4, which can be attributed to the thread cutting. The follow-up quantity of thread is formed. In this case, the bobbin 3 continues to turn whilst the sewing signal is stationary. It should be noted in this context that the inactive time $T_i$ which occurs in principle or the excess thread length can be additionally shortened appreciably by using a hot cutter compared with an equivalent arrangement using a conventional thread cutter. A total response time of the monitoring system is give by adding the inactive time $T_i$ and the time for one complete colour change. Thus, at the start of a sewing process using a 2*3 coded bobbin 3 and 1 mm thread consumption per stitch, inactive periods of 12*2*2=26 stitches have been sensed whereas with 5 mm thread consumption, only 2*2+2=6 stitches have been sensed before sensing a first complete code change r,g,b. In a basic safety setting in the present process, at 5 mm tread consumption a tolerance range of about 10 stitches and an additional inactive time $T_i$ of about 10-15 stitches before detecting a first complete colour change is therefore provided before a thread break etc. is detected. Depending on the application, this value can be reduced to about 5 stitches or increased to more than 15 stitches, as already specified.

The time sequence of the colour sensor signals S2, S3, S4 at the corresponding outputs of the rgb colour sensor also has various time widths during correct sensing but a uniform direction of rotation is always detected from the sequence of the respective signals S2, S3, S4.

Figure 5A:
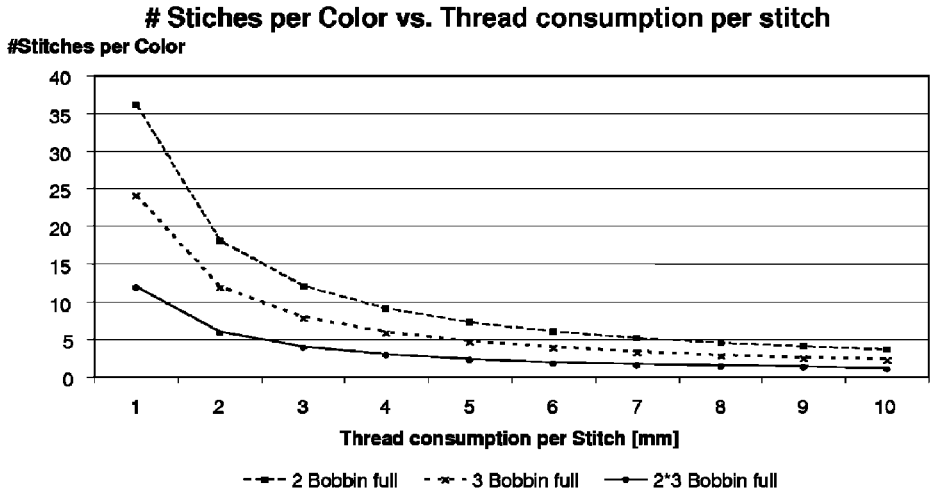
FIGS. 5*a* and 5*b*: are time diagrams to show a length of a sensing phase as well as an inactive time before processing of loose exceed thread after a cutting process before response of a sensor depending on the respective colour scale division.
Figure 5B:
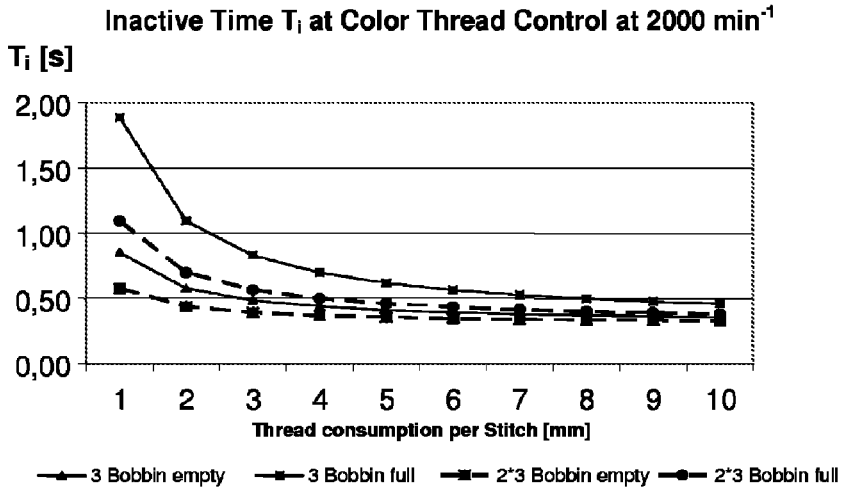

FIGS. 5*a* and 5*b* each show time diagrams as a function of a respective colour scale division on a lower bobbin 3. FIG. 5*a* shows a length of each colour in process, FIG. 5*b* shows a length of an inactive time $T_i$ before processing a loose excess thread after a cutting process before a sensor responds. It can be seen from FIG. 5*b* that the response time of a colour sensor with 2*3=6 markings, i.e., using two sequences of rgb codings over a circumferential rotation of the bobbin, is about 1.1 s at 2000 revolutions per minute and 1 mm thread consumption. When the thread consumption is 5 mm, the inactive time $T_i$ of the monitoring system is less than 0.5 s. Whereas each of the codings shown operates reliably at higher thread consumption, for lower thread consumption per stitch a coding with 2*3=6 markings should be recommended for a sufficiently short response time and 3*3=9 markings for receiving a very short response time.

In the course of a change of application with altered requirements, this can be flexibly taken into account simply by changing the lower bobbin 3. In one embodiment of the invention, default values for the monitoring system described hereinbefore are read in centrally via an electronic evaluation and control unit without being further represented by drawings, and a bobbin coding and direction of rotation are also monitored centrally.

LIST OF REFERENCE NUMERALS

1 sewing machine
2 sewing table
3 bobbin
4 rotary gripper
5 bobbin casing
6 recess
7
8 optical device
9 active multi-colour radiation source
10 marking
11
12 outer front side
13
14 second optical device
15 electro discharge machining
16 annular segment
17 nozzle
g Colour green
r Colour red
b Colour blue
D axis of rotation
S radiation axis S
a value of recessing received via electro discharge machining
z intermediate space formed by a web
d average diameter of the annular segments 16
S1 needle sensor signal
S2 individual output signal of an rgb colour sensor
S3 individual output signal of an rgb colour sensor
S4 individual output signal of an rgb colour sensor
$T_i$ inactive time

The invention claimed is:

1. A device for monitoring a thread wound on a bobbin (3) during operation in a sewing machine (1), wherein at least two different marking states are provided in the area of the bobbin (3) and are coupled to an optical device (8) in such a manner that movement of the bobbin (3) produces a change in marking which can be detected in the optical device (8) which can be evaluated in a logic unit connected to the optical device (8), characterised in that the marking (10) in the area of the bobbin (3) comprises 3 or more marking states, wherein at least one state is defined by at least one true colour (g, r, b) or a mixture of the primary colours.

2. The device according to claim 1, characterised in that the marking (10) of the bobbin (3) comprises at least two different true colours (g, r, b) or mixtures of the primary colours.

3. The device according to claim 1, characterised in that the marking (10) comprises three states in the form of three different true colours (g, r, b).

4. The device according to claim 1, characterised in that the thread is a lower thread and the bobbin (3) is a lower bobbin.

5. The device according to claim 1, characterised in that the marking (10) is provided on at least one of the two outer front sides (12) of the bobbin (3).

6. The device according to claim 5, characterised in that the marking (10) is provided on both outer front sides (12) of the bobbin (3) with the same colour sequence of markings (10) or identically.

7. The device according to claim 1, characterised in that the marking (10) is provided in the form of colour segments or annular sections (16) radially to an axis of rotation (D) of the bobbin (3).

8. The device according to claim 1, characterised in that the marking (10) is arranged in an electro discharge machinings (15).

9. The device according to claim 1, characterised in that an active multi-colour radiation source (9) and a corresponding detector are provided as the optical device (8), wherein the optical device (8) cooperates with corresponding markings (10) and in particular, is formed as an active rgb sensor.

10. The device according to claim 9, characterised in that the optical device (8) cooperates with markings (10) in the true colours blue, green and red (b, g, r) or a mixture of the primary colours.

11. The device according to claim 1, characterised in that a multiple of a pattern sequence (g, r, b) is disposed on the outer front side (12) of the bobbin (3).

12. The device according to claim 1, characterised in that a nozzle (17) for producing a contamination-repelling excess pressure area is disposed on the optical device (8, 14).

13. A method for monitoring a thread wound on a bobbin (3) during operation in a sewing machine (1), wherein markings (10) comprising at least two states turn with the bobbin (3) during its movement and a change in the states during each movement of the bobbin (3) is detected in the course of scanning with an optical device (8) and is evaluated in a logic unit, characterised in that changes between three or more states or markings (10) are detected or processed using at least one true colour (r, g, b) or a mixture of the primary colours.

14. The method according to the claim 13, characterised in that a direction of turning of the bobbin (3) is detected by evaluating a pattern and/or colour sequence.

15. The method according to claim 13, characterised in that from starting a new sewing process, a measure of about 5 to about 19 stitches without detecting a turning of the bobbin (3) is awaited before outputting an error message.

16. The method according to claim 15, characterised in that this measure is adjusted according to the geometry of the sewing material and the stitch length.

17. The method according to claim 13, characterised in that a change in a lower bobbin is monitored and optionally also logged by at least one second optical device (4) or an axial sensor based on recognition of a light/dark transition when the machine is at a standstill.

18. The method according to claim 13, characterised in that the optical device (8) is tested for reliability by withdrawing thread when the machine is at a standstill until all defined states have been passed through at least once and have been notified as recognised.

19. The method according to claim 13, characterised in that a contamination-repelling excess pressure region is created in the area of the optical device (8) by using purified compressed air by metering and triggering by a solenoid valve.

* * * * *